United States Patent [19]

Husson et al.

[11] 4,357,997

[45] Nov. 9, 1982

[54] ELEVATOR SYSTEM

[75] Inventors: Alan L. Husson, Hackettstown, N.J.; Michael J. Dynak, Springfield, Ill.

[73] Assignee: Westinghouse Electric Corp., Pittsburgh, Pa.

[21] Appl. No.: 234,074

[22] Filed: Feb. 12, 1981

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 2,772,752 | 12/1956 | Suozzo et al. | 187/29 |
| 2,795,298 | 6/1957 | Suozzo et al. | 187/29 |
| 2,857,987 | 10/1958 | Savino et al. | 187/29 |
| 2,998,866 | 9/1961 | Dinning | 187/29 |
| 3,065,824 | 11/1962 | Burgy et al. | 187/29 |
| 3,080,945 | 3/1963 | Dinning et al. | 187/29 |
| 3,504,771 | 4/1970 | Suozzo et al. | 187/29 |
| 3,509,969 | 5/1970 | Suozzo et al. | 187/29 |
| 3,584,707 | 6/1971 | Suozzo et al. | 187/29 |
| 4,129,199 | 12/1978 | MacDonald | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system which improves service to floors located below the main floor, i.e., basement and sub-basement floors, by treating up and down hall calls originating from these floors as separate up and down basement zones. A hall call is allocated to a suitably conditioned busy car, if such a car can be found, and if the hall call cannot be so allocated, a demand is created for the zone associated with the call. Non-busy cars which are available for assignment are assigned to demands in a predetermined zone priority order, with the up basement zone being higher in this priority order than the down basement zone.

9 Claims, 16 Drawing Figures

ELEVATOR SYSTEM

BACKGROUND OF THE INVENTION

1. Field of the Invention

The invention relates in general to elevator systems, and more specifically group supervisory strategy for improving service to floors located below the main floor, i.e., basement and subbasement floors.

2. Description of the Prior Art:

In general, group supervisory strategy for controlling a group or bank of elevator cars to serve floor calls in a building deliberately provides preferred service for the main floor and those above it. A car, when assigned to the basement zone, serves down basement floor calls first. It then reverses after the last car call for the down service direction has been served to serve the up basement floor calls. Thus, a prospective passenger placing a call from a floor below the main floor, such as a basement, or subbasement floor, may experience a relatively long wait for service. This low service priority for basement floor calls is acceptable when the majority of the elevator traffic enters the building at the main floor and travels upwardly to destination floors, with the basement floors being used primarily by maintenance personnel. The basic group supervisory strategies of the prior art are modified for buildings which have parking garages below the main floor, or additional street entrances below the main floor, such as by allowing more than one car to be assigned to the basement zone, and/or by allowing a car assigned to the basement zone to by-pass non-timed out floor calls located above the basement zone as it travels to serve the basement zone assignment, when a basement call has timed out.

SUMMARY OF THE INVENTION

Briefly, the present invention provides a significant improvement in service to basement up calls, without an offsetting degradation of service to other up calls, by dividing the basement into two service direction zones, up and down. A demand for service for the basement up zone is created or registered when an up call is registered from a basement floor, there is no up-running, busy basement car in position to answer it, and an available or non-busy car has not already been assigned to answer the lowest basement up call. A basement up demand is given a higher priority in the assignment of available cars to demands than calls from the basement down zone, and also a higher priority than up direction demands located above the main floor. Giving the basement up zone a higher priority than up zones located above the main floor does not significantly degrade the service to the floors located above the main floor, as most up basement demands will cause the assigned car to automatically become a busy car capable of serving up calls registered from the floors above the main floor.

Unlike most basement strategies, a car assigned to the basement up demand will by-pass basement down calls as it proceeds to the lowest basement up call.

As hereinbefore stated the down basement call zone will have a lower priority than the basement up call zone. However, since cars assigned the the basement up zone are prevented from answering basement down floor calls, such up assigned basement cars will not be counted against the basement quota of cars allowed to serve basement down calls.

BRIEF DESCRIPTION OF THE DRAWINGS

The invention may be better understood and further advantages and uses thereof more readily apparent, when considered in view with the following detailed description of exemplary embodiments, taken with the accompanying drawings in which.

DESCRIPTION OF THE PREFERRED EMBODIMENTS

Figure 1:
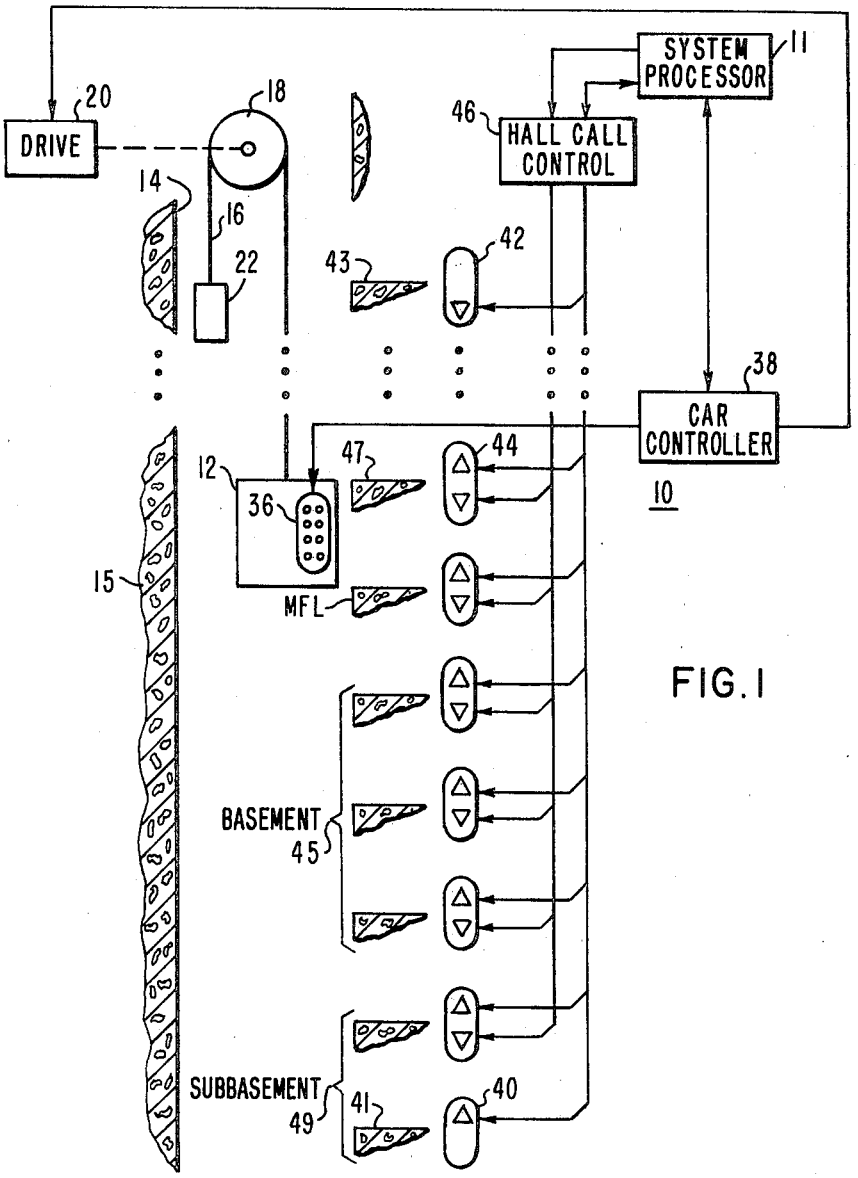
FIG. 1 is a diagrammatic representation of an elevator system which may be constructed according to the teachings of the invention.

Referring now to the drawings, and to FIG. 1 in particular there is shown an elevator system 10 which may be constructed according to the teachings of the invention. In order to simplify the description, the elevator system 10 is shown in block form. U.S. Pat. Nos. 3,750,850; 3,804,209; and 3,851,733 which are all assigned to the same assignee as the present application, collectively describe a complete elevator system which may utilize the teachings of the invention, and these patents are hereby incorporated into this application by reference. The '850 patent discloses control for operating a single elevator car without regard to operation of the car in a bank of cars. The '209 and '733 patents disclose the control necessary to operate a plurality of elevator cars in a bank under the direction of a programmable system processor.

More specifically, elevator system 10 includes a plurality of elevator cars, such as elevator car 12, with the plurality of elevator cars being under group supervisory control via a programmable system processor 11. The cars, such as car 12, are each disposed in the hatchway 14 of a building 15 having a plurality of landings or floors. The elevator cars are mounted for movement in their respective hatchways of the building to serve the floors therein, such as illustrated for elevator car 12. Elevator car 12 is supported by a plurality of ropes 16 which are reeved over a traction sheave 18. A counterweight 22 is connected to the other ends of the ropes 16. Sheave 18 is driven by a suitable traction elevator drive machine 20 which may include a direct current motor and voltage source, such as used in the Ward-Leonard drive system, or in a solid state drive system. Hall calls, also called floor calls, are registered by push buttons mounted at the various floors or landings, such as by an up direction push button located at the lowest floor 41 in the building 15, a down direction push button 42 located at the highest floor 43 of the building, and up and down direction push buttons 44 located at each of the intermediate landings. Since the invention is directed to improving basement service, in addition to the uppermost and lowest floors, only the basement floors, shown generally at 45, subbasement floors shown generally at 47, the main floor MFL, and the second floor 47, are illustrated.

The floor calls from the various floors are recorded and serialized in hall call control 46. The serialized hall calls from hall call control 46 are directed to the system processor 11. Car calls, registered by suitable push buttons 36 located within each elevator car, are directed to the associated car controller 38, which includes the floor selector and speed pattern generator.

As described in the incorporated patents, the programmable system processor 11 includes allocation means which attempts to allocate a hall call to a suitably conditioned elevator car which is already busy serving car, or hall calls, with this allocation means being implemented by a subprogram ACL. In the event a call cannot be allocated to a busy car, program ACL registers a demand for the zone associated with the call. Availability means, implemented by a subprogram CSU, determines if a car is "available", with an "available" car being an in-service car which is not presently serving a call for elevator service, and which does not have any assignments such as PARK or NEXT. Assigning means, implemented by a subprogram ACR, assigns an available car to the zone of the demand. The floor selector in the car controller 38 for each elevator car provides an available signal AVAS for the system processor 11 when its associated car is in service, not running or decelerating, and its doors are closed. The system processor 11 then makes its own decision as to whether or not the car is available for demand assignments, providing a signal AVAD when it is available for such an assignment. The present application is related to new and improved strategy for improving service to the basement, and subbasement, floors which includes a new and improved arrangement for assigning available cars to zone demands, as will be hereinafter described.

When the hall call registers are read, the information is stored in a memory location called the call record CLR, with the calls being stored therein on a one bit per floor per direction basis. The latest call record is periodically compared with the immediately preceding call record and a bit is set in a call change record CCLR for each change which is noted. Thus, a new up hall call, or a new down hall call, will set a bit in the call change record, since a set bit will appear for the call floor in the latest reading of the hall call register, but not in the previous reading. In like manner, a cancelled hall, i.e., one that has been answered, will set a bit in the call change record, since a set bit will appear for the associated call floor in the previous record, but not in the latest record.

When a program allocates a hall call to a car, or assigns a car to a specific floor, it sets an indicator bit for the floor in question in the car assignment table CRA. If the car is a runnng car and the call is allocated to it by program ACL, the program, in addition to setting the bit associated with the floor of the call in the cars assignment table must check to see if this call is closer to the car than the stop previously sent to the car. If so, it must replace the "next stop" address with the address of this call. If the car is an available car being assigned to a zone demand by program ACR, in addition to placing the call in the car assignment table CRA of the car, it must assign the service direction for the car, give it a start signal, and send the address of the floor to the car. If the zone demand has several calls associated with it, such as a number of high zone up calls, all the calls associated with the demand are placed in the car assignment table CRA of the car, and the floor address of the first stop is sent to the car. Suitable formats for the call record CLR, the call change record CCLR, and the car assignment table CRA, are set forth in FIG. 7 of the incorporated '733 patent.

Figure 2:
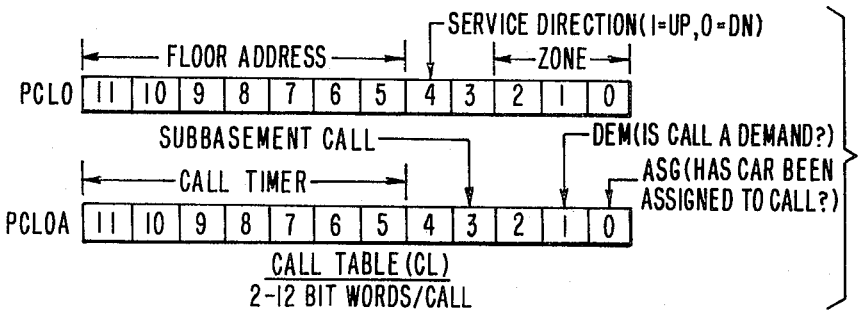
FIG. 2 is a diagrammatic representation illustrating the two binary words placed into a call table for each hall or floor call.
Figure 3:
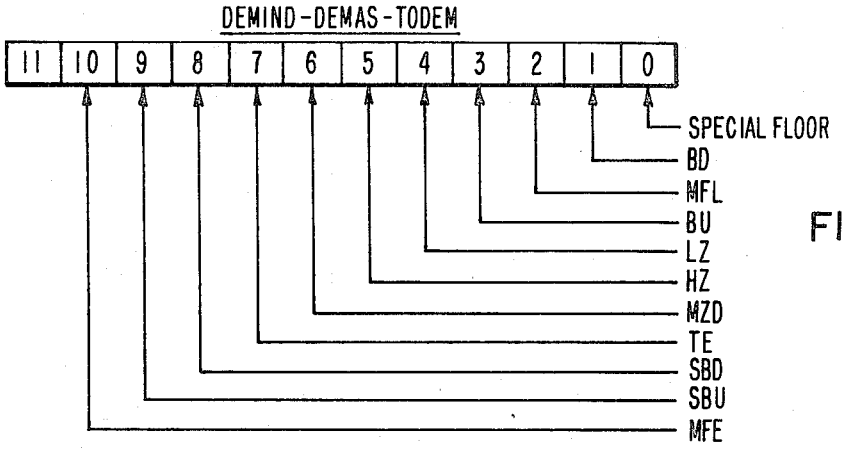
FIG. 3 is a diagrammatic representation of certain registers maintained to monitor and serve system demands from various building call zones.
Figure 8:
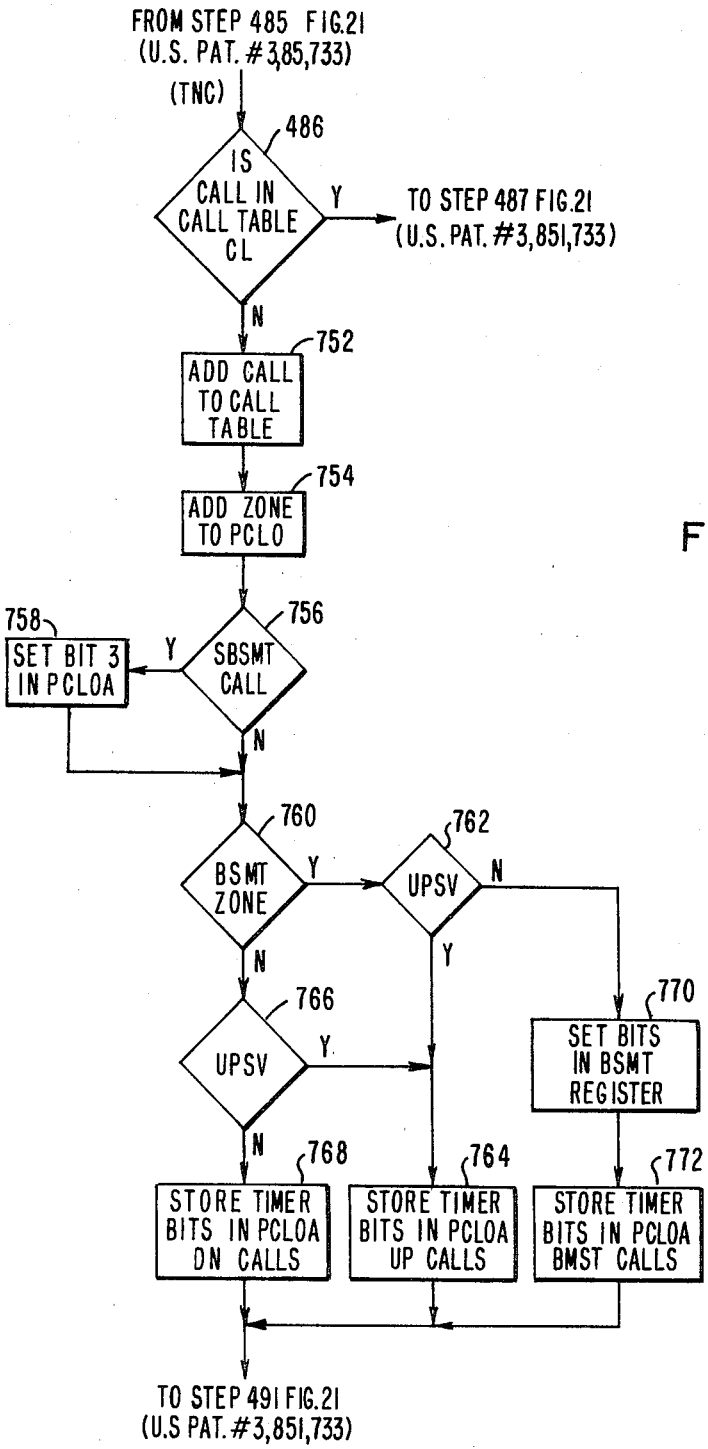
FIG. 8 is a flow chart of a program which may be used to implement the tabulation of new hall calls (TNC) according to the invention.
Figure 9:
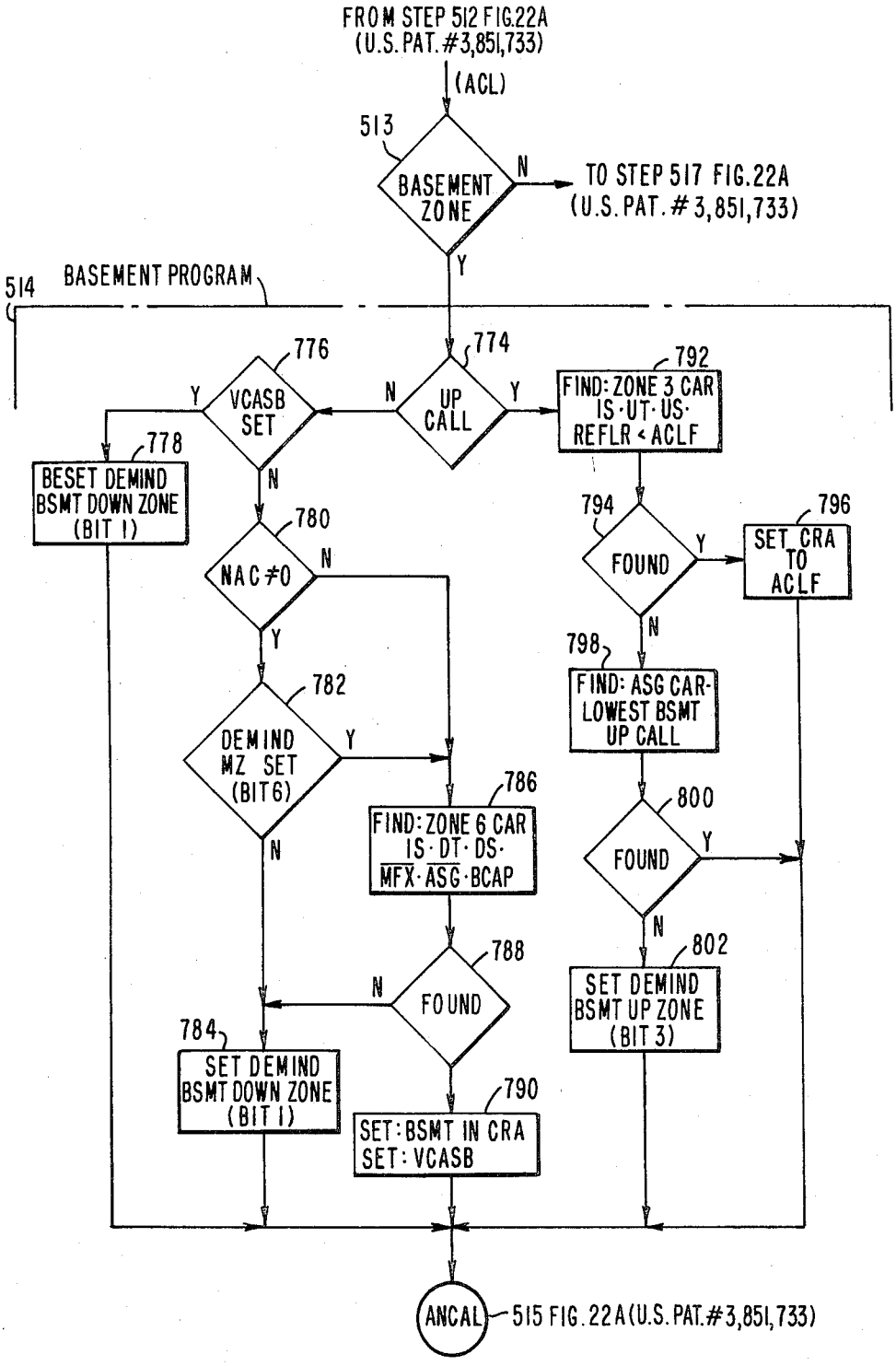
FIG. 9 is a flow chart of a program for allocating calls (ACL) to busy cars, and for registering demands for those not allocated, according to the invention.

Certain of the figures in the instant application are substantially the same as those in the incorporated '733 patent, and certain of the figures illustrate the additions and/or changes which may be made to certain of the figures in the incorporated '733 patent in order to implement the teachings of the present invention. For example, FIG. 2 is substantially the same as FIG. 8 of this incorporated patent, FIG. 3 is similar to FIG. 10, and FIGS. 4, 5 and 6 are similar to FIGS. 13, 14 and 15, respectively. Further, FIG. 7 of the instant application illustrates modifications and additions to FIG. 20 of the incorporated patent, FIG. 8 illustrates modifications and additions to FIG. 21, FIG. 9 illustrates modifications and additions to FIG. 22, and FIGS. 11 through 15 illustrate modifications and additions to FIG. 23.

More specifically, FIG. 2 illustrates two 12-bit words which are stored in a call table CL for each hall or floor call registered. The first word PCLO maintains a 3-bit binary word corresponding to the zone of the call (bits 0–2), bit 4 of the word establishes the service direction of the call, with a logical one indicating up and a logical zero indicating down, and bits 5 through 11 store the address of the call floor in binary. The second word associated with each call, referred to as word PCLOA, uses bit position 1 to flag whether or not the call is a demand call, and bit position 0 to indicate whether or not a car has been assigned to the floor of the call. Bits 5 through 11 are used as the call timer. The binary number representative of the registration time which will cause the call to become "timed out", is stored at this location when the call is first placed in the call record. This binary number is decremented on each running of a subprogram TIME, going negative when the call times out. If the building has a subbasement, bit 3 of word PCLOA may be set to indicate that the call is from the subbasement.

As will be hereinafter described, an important element of the present invention is the dividing of the basement floors into two service zones, up and down, instead of treating the floors below the main floor as a single service zone. In addition to placing basement calls into two zones according to service direction, it may be convenient for the system processor to further break down these two zones, if all elevator cars cannot service all of the floors below the basement. This further subdivision will be used by the various programs in determining if a specific call can be allocated to a certain busy car, or if a zone demand can be properly assigned to a specific car, depending upon the floor capabilities of the various cars. The additional breakdown, for example, may be referred to as subbasement up and down, and basement up and down. While it is important for the system processor to maintain this further subdivision of the basement up and down zones, the strategy of the present invention may collectively refer to all floors below the main floor as basement floors, with these basement floors being divided into two zones according to service direction therefrom, i.e., a basement up zone and a basement down zone.

FIG. 3 illustrates data words DEMIND, TODEM, and DEMAS, which words are maintained by the system processor 11. Word DEMIND is a demand indicator word, with bits of the word being assigned to different types of service demands. For example, a main floor demand (MFE) for service to a top extension floor is assigned to bit 10, up and down demands (SBU) and (SBD) from the subbasement are assigned to bits 9 and 8, respectively, a top extension demand (TE) is assigned to bit 7, a main zone down demand (MZD) is assigned to bit 6, a high zone up demand (HZ) is assigned to bit 5, a low zone up demand (LZ) is assigned to bit 4, a basement up demand (BU) is assigned to bit 3, a main floor demand (MFL) is assigned to bit 2, and a basement down demand (BD) is assigned to bit 1. A demand associated with a special floor may be assigned to bit position 0.

Figure 4:
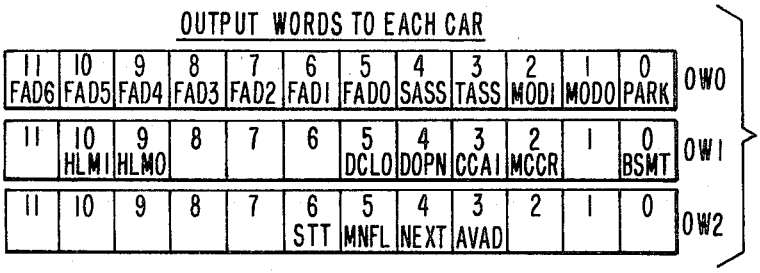
FIG. 4 is a diagrammatic representation of output words prepared by the system processor for each elevator car of the system, which are sent to the associated car controllers thereof.

FIG. 4 illustrates three 12-bit output words OW0, OW1 and OW2 which are sent to each car controller 38 by the system processor 11. These words include the various commands sent to each elevator car by the system processor 11, in order to dispatch the cars and have the hall calls answered according to a predetermined programmed strategy. The information conveyed by these words may be obtained by looking up the appropriate symbol in a table set forth in the incorporated '733 patent.

Figure 5:
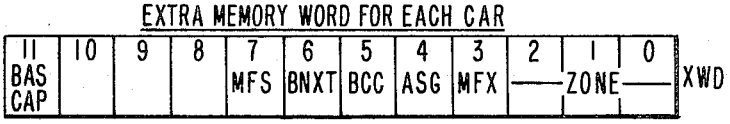
FIG. 5 is a diagrammatic representation of an additional memory word XWD for each elevator car, which is maintained by the system processor.

FIG. 5 illustrates an additional or extra memory word XWD maintained by the system processor 11 for each elevator car to further aid the system processor in determining the present status of each car. The information contained in word XWD may also be identified by referring to the listing of signals and program identifiers in the table set forth in the incorporated '733 patent.

Figure 6:
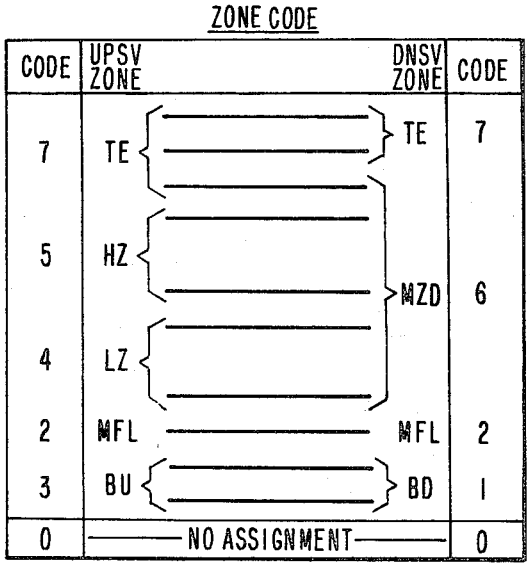
FIG. 6 is a diagrammatic representation of a zone code which identifies hall call location and direction, as well as the location of the elevator cars.

FIG. 6 illustrates how a building may be zoned and coded, to provide a zone code used by the system processor 11 to keep track of hall call demands and the elevator cars. A basement hall call for down service, or a basement car set for down service, uses the zone code of 1. In like manner, the main floor MFL is assigned to zone code 2, the basement up zone uses zone code 3, low and high zone calls for up service registered from floors located between the main floor and top extension TE uses zones 4 and 5, respectively, down calls from the floors located between the main floor MFL and the top extension TE are assigned zone code 6, and the top extension TE is assigned zone code 7. A car with no assignment is given a zone code of zero. If the building has an express zone, this group or zone of floors may be given the zone code of 8.

Subprogram CSU, shown in FIGS. 19 and 20 (20*a*, 20*b*, 20*c*) of the incorporated '733 patent, reads and stores car status data provided by the controllers of the elevator cars in the bank, and it also compares the new data record with the previous data record in order to detect events requiring action. Subprogram CSU places subprograms TNC and ACR into bid, as required by the detected events, and sets a flag for function program ACL in response to detected events.

Figure 7A:
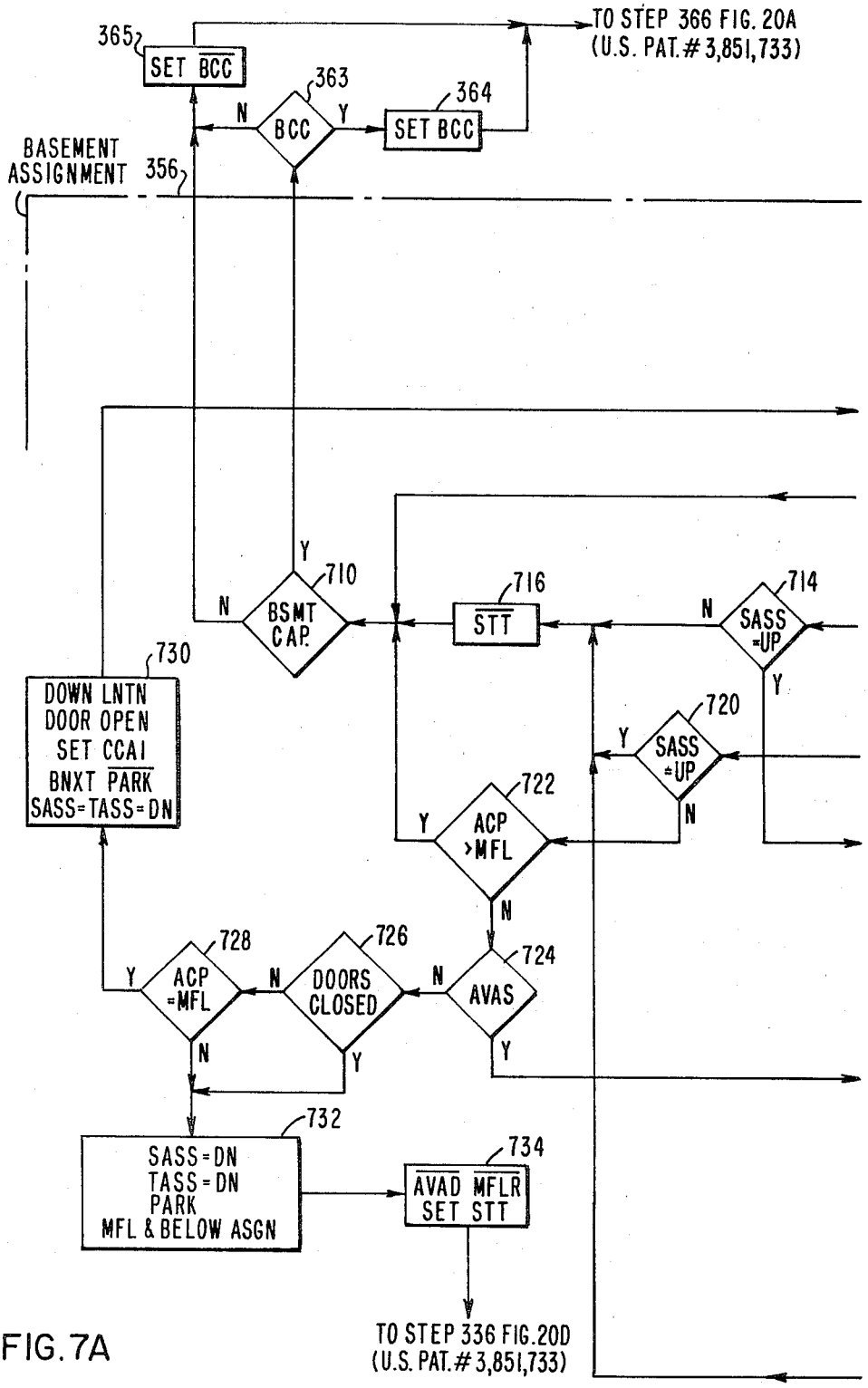
FIGS. 7A and 7B may be assembled to provide a flow chart of a program which may be used to implement a car status update (CSU) function according to the invention.
Figure 7B:
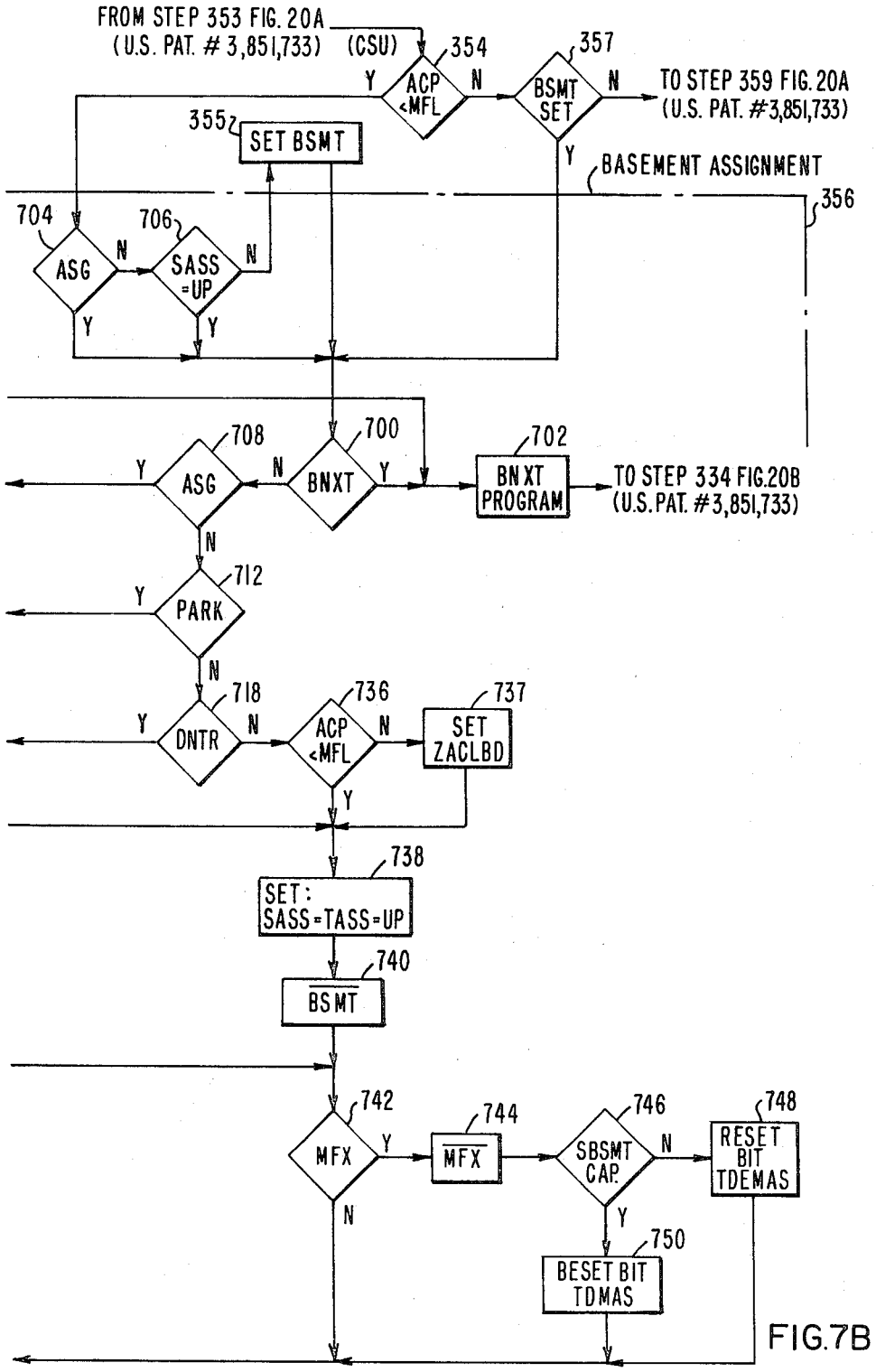

FIG. 7 illustrates modifications and additions to program CSU which may be made to implement the teachings of the invention. For example, when step 354 checks the advanced car position of a car, if the car is located at or above the main floor MFL, step 357 checks to see if the car is going to travel to the basement to serve basement down calls. If so, bit 0 of OW1 will be set (FIG. 4). If not, the program advances to step 359 of the incorporated '733 patent. If the basement bit BSMT (bit 0 of OW1) is set, step 700 checks to see if the car is going to stop at the main floor and become BNXT, i.e., the NEXT car to serve the basement from the main floor. Bit 6 of XWD shown in FIG. 5 will be set if it has been selected as BNXT. If the car is BNXT, the program advances to step 702 to execute the basement NEXT program. The program then advances to step 334 of the incorporated '733 patent.

If step 354 found that the car is located below the main floor, step 704 checks bit 4 of XWD to see if the car is ASG, i.e., assigned to a zone demand. If the car is an assigned car the program advances to stop 700. If it is not assigned, step 706 checks bit 4 of OWO to check if its assigned service direction SASS is up. If it is, the program advances to step 700. If its assigned service direction SASS is down, step 355 sets the basement bit (bit 0 of OW1) and the program advances to step 700.

If the car is not BNXT, step 708 checks to see if the car is ASG, i.e., assigned to a zone demand. If it is, step 710 makes sure the car has the capability of serving the basement. If it does not have this capability, step 365 sets bit 5 of XWD to 0 (BCC) to indicate no basement car calls, and the program advances to step 366 of FIG. 20*a* of the incorporated '733 patent. If step 710 finds the car has the capability of serving the basement, step 363 checks to see if it has a basement car call. If it has, step 364 sets bit 5, BCC, of XWD, and if it does not, step 365 resets this bit.

If step 708 finds the car not assigned, step 712 checks bit 0 (PARK) of OWO to see if it has been given an assignment to park at a predetermined floor. If it has a PARK assignment, step 714 checks its assigned service direction SASS, bit 4 of OWO. If the assigned service direction SASS is down, step 716 resets bit 6 (STT) of OW2 to indicate that the car is not on a basement "through trip" and the program advances to step 710. When a car is on basement through trip, it will automatically answer all the basement down hall calls ahead of it, and when there are no further down calls, it will reverse and answer up basement hall calls.

If step 712 did not find a PARK assignment, step 718 checks the actual car travel direction. If the car is set for down travel, step 720 checks its assigned service direction SASS. If the car is traveling down to serve an up call, the program advances to step 716. If it is traveling down and its assigned service direction is down, step 722 checks the position of the car. If the car is located above the main floor, the program advances to step 710. If the car is at, or below the main floor, step 724 checks to see if the car is available according to the floor selector (AVAS). If it is not available, step 726 checks the position of the doors. If the doors are not closed, step 728 checks to see if the car is located at the main floor. If it is at the main floor, step 730 arranges bits 8 and 9 (HLM0 and HLM1) of OW1 to 1-0, respectively, to request that the down hall lantern be turned on, it sets bit 4 (DOPN) of OW1 to give a door open command, it sets bit 3 (CCAI) of OW1 to inhibit car calls, it sets bit 6 (BNXT) of XWD to indicate the car is basement NEXT, it resets bit 0 (PARK) of OW0 to indicate the car has not been given a PARK assignment, and it resets bits 3 and 4 of OW0 to indicate a down travel (TASS) and down service (SASS) assignment.

If step 724 found the car not available for assignment, and step 726 found the doors closed, or the doors open and step 728 found the car not located at the main floor, step 732 resets bits 3 and 4 of OW0 to give down travel TASS and down service SASS assignments, bit 0 of OW0 is set to give the car a PARK assignment, and the address mode bits 1 and 2 (MOD0 and MOD1) of OW0 are set to 1, 1, such that the car can "see" calls from the main floor and below. Step 734 resets bit 3 of OW2 to indicate that the car is not available for assignment, it resets bit 5 of OW2 to indicate that the car does not have a main floor assignment, and it sets STT, bit 6 of OW2, to indicate that the car is on a through trip basement assignment. Step 734 then advances to step 336 of FIG. 20*d* of the incorporated '733 patent.

If step 718 found the car not set for down travel, step 736 checks the advanced car position. If the car is at, or above, the main floor, step 736 sets indicator ZACLBD. This indicator is set because the car was in the basement, or it had a basement assignment, determined by steps by 354 and 357, and the car is now at, or above, the main floor, not set for down travel. This is an "event" which is flagged by the setting of indicator ZACLBD, requesting the reprocessing of all calls in the call table the next time program ACL runs.

If step 736 found the car, which is not set for down travel, in the basement, step 738 sets bits 3 and 4 of OW0 to give up travel (TASS) and up service (SASS) assignments, and step 740 resets the basement bit, bit 0 of OW1.

Step 736 also advances to step 738, as the basement service has been completed. Step 714 also advances to step 738 if the car has a PARK assignment and the assigned service direction is up.

Step 740 advances to step 742, which checks bit 3 of XWD to see if the car is, or had been, expressing to the main floor. Step 724 also advances to step 742 if the car is located at, or below, the main floor, with a down service assignment, but is now available for assignment according to the car's floor selector. If step 742 finds the car is not expressing to the main floor, the program advances to step 716. If step 742 finds the main floor express bit (MFX) set, step 744 resets it. Since to reach this point in the program the car has completed any basement assignment, the basement demands are reset via steps 746, 748 and 750 and the program advances to step 716. This completes the basement related portion of the car status update.

FIG. 8 illustrates the modifications and additions to subprogram TNC shown in FIG. 21 of incorporated '733 patent. Subprogram TNC reads the status of the hall call registers and makes a comparison with the previous record to detect the arrival of new calls. New calls are added to the call table CL, which keeps a record of the floor number, service direction, and elapsed time since the call was registered, for each call. Subprogram TNC also detects the cancelling of a hall call, and removes the call from the call record. Subprogram TNC also places subprogram ACL into bid.

More specifically, step 486 of program TNC checks to see if the call being considered is in the call table CL. If it is, the "change" was due an answered call, not a new call, and the program advances to step 487 in FIG. 21 of the incorporated '733 patent to remove the call from, and to compact, the call table. If the call is not in the call table, it is a newly registered call, and step 752 adds the call to the call table CL. Step 754 adds the zone of the call to bits 0, 1 and 2 of the first call word PCLO shown in FIG. 2. Step 756 checks to see if the call is from the subbasement, and if the it is, step 758 sets bit 3 of the second call word PCLOA. The program then advances to a group of program steps which determine the length of time which will cause the call to become "timed out", it it is not answered before this amount of time has elapsed. Basement up calls may be timed the same as non-basement up calls. Basement down calls may have another predetermined period of time, different than up calls. Non-basement down calls may have still another different period of time.

More specifically, step 760 checks to see if the the call is from a basement zone, and if it is, and the call is for up service, determined by step 762, step 764 stores the timer setting for timing up calls in bits 5 through 11 of the second call word PCLOA. If the call is not from the basement zone, step 766 checks the service direction of the call, and if it is for up service, step 764 sets the time for up calls. If the call is not from the basement, and if it is for down service, step 768 stores the timed value for down calls. If the call is for down service from the basement zones, step 770 sets the appropriate bits in the car's call register, and step 772 stores the timed out value for basement down calls. In general, the timing value for the basement down calls is longer than the timing value for non-basement down calls, and for up calls. The time for non-basement down calls and up calls is normally set to be the same during normal traffic conditions, but during certain peak traffic conditions, the times may be modified.

FIG. 9 illustrates additions and modifications to subprogram ACL shown in FIG. 22 of the incorporated '733 patent. Subprogram ACL allocates a call to a running or busy car that is suitably conditioned, i.e., located relative to the call and with a travel and service direction such that the car will be able to answer the call as it proceeds on its journey through the building. Any call that cannot be allocated by program ACL causes program ACL to create or register a demand signal which signifies that an available car should be assigned to serve the call, or zone of the call. Subprogram ACL registers the demand signal, including a signal identifying the type of demand, but the assignment of an available car to the call is performed in subprogram ACR.

Subprogram ACL normally only allocates new calls detected since it last ran, as the other calls in the call table were processed, i.e., either allocated to busy cars, of flagged as demand calls, during previous running cycles. However, when flag or indicator ZACLBD is set by subprogram CSU in response to the detection of an event which may require reallocation of one or more calls, subprogram ACL will process all of the calls in the call table.

More specifically, the present invention "fills in" block 514 of FIG. 22*a* of the incorporated '733 patent, which is entered when step 513 finds the call being processed is from a basement zone. Step 774 checks the service direction of the call. If the call is a down call, step 776 checks to see if an indicator flag VCASB is set. If it is, it indicates that a car has already been assigned to serve basement down calls, and step 778 resets the demand by resetting bit 1 of word DEMIND (FIG. 3), and the program advances to terminal 515 to process the next call in the call table.

If step 776 finds no car has been assigned to basement down calls, step 780 checks to see if there is an available car which could be assigned to this call by program ACR. If there is an available car, step 782 checks to make sure there is no demand for the main zone down MZD (zone 6 of FIG. 6). If there is no main zone down demand, step 784 registers the demand for the basement zone by setting bit 1 of DEMIND (FIG. 3).

If step 780 finds there are no available cars, or if there is an available car but there is a main zone down demand, step 786 checks to see if the call can be allocated to a suitably conditioned busy car. The suitably conditioned busy car is an in-service car set for down travel and down service in zone 6, i.e., serving down calls from floors located above the main floor. Further, the car must not be expressing to the main floor (MFX), it must not be an assigned car (ASG) and it must have basement basic capability. Step 788 checks to see if such a car has been found by step 786. If such a car was found, step 790 sets the appropriate basement floor bit in the car assignment table CRA, and it sets indicator VCASB to indicate that a car has been given a basement down call assignment. If such a car cannot be found, step 788 proceeds to step 784 to register a basement down zone demand.

If step 774 finds the basement call is for up service, step 792 checks to see if there is an in-service car set for up travel and up service already serving basement up calls, i.e., a zone three car, with the floor of the car REFLR below the call floor ACLF. Step 794 checks to see if such a car was found, and if so, step 796 allocates the call to the car by setting the call floor bit in the car's assignment table CRA.

If such a busy car was not found by step 794, step 798 checks to see if a car has already been assigned to serve the lowest basement up call. If step 800 finds that such an assignment has already been made, the program advances to terminal 515 to process the next call in the table. If step 800 finds no car assigned to the lowest basement up call, step 802 registers a demand for the basement up zone by setting bit three of DEMIND.

Subprogram ACR, which is placed into bidding by subprogram CSU only when there is a demand in the system, and there is an available car which can be assigned to the demand, assigns available cars to demands in an order of priority specified by the strategy. A demand may be a single call, or a group of calls from a single zone. Program ACR assigns a call to each demand until all demands are satisfied, or no available car remains, and it outputs a command to each car it assigns.

Figure 10:
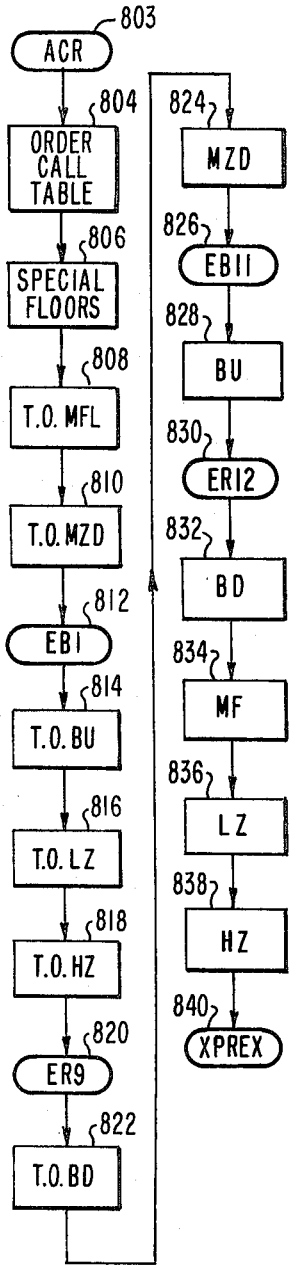
FIG. 10 is a block diagram of a program for assigning available cars (ACR) to demands created by program ACL, with the priority order being set forth according to the invention.

FIG. 10 is a block diagram of program ACR which indicates the new zone demand priority order according to the teachings of the invention. An important change is the dividing of the floors below the main floor into two zones according to service direction, i.e., a basement down service zone, and a basement up service zone. Further, the basement up zone is given a high priority than the basement down zone. Still further, the basement up zone has a higher priority than the low zone and high zone up calls from floors located above the main floor, as the satisfying of a demand in the basement up zone will create a "busy" car which will usually continue into the low and high up zones. Thus, low and high zone up calls may be allocated to this busy car by program ACL.

More specifically, program ACR is entered at terminal 803 in FIG. 10, and step 804 orders the call table, i.e., it places the calls in the same relative positions as their associated floors in the building. Available cars are then assigned, in the following order, to demands, such as a demand from a special floor in step 806, a timed out main floor demand in step 808, and a timed out main zone down demand in step 810. A timed out basement up demand is then processed, entering the program at terminal 812 and continuing generally at step 814. Step 814 is expanded in FIG. 11, which will be hereinafter described.

The program then processes timed out low zone and timed out high zone up calls in steps 816 and 818, respectively, and it then enters terminal 820 to process a timed out basement down demand, shown generally at step 822. Step 822 is expanded in FIG. 12, which will be hereinafter described.

When there are no timed out demands, the strategy satisfies main zone down demands in step 824 and then enters terminal 826 to process basement up demands in step 828. Step 828 is expanded in FIG. 13. The program then enters terminal 830 to process basement down demands in step 832, which is expanded in FIG. 14. Main floor, low zone up and high zone up demands are then processed in steps 834, 836 and 838, respectively, and the program returns to the priority executive from terminal 840.

Figure 11:
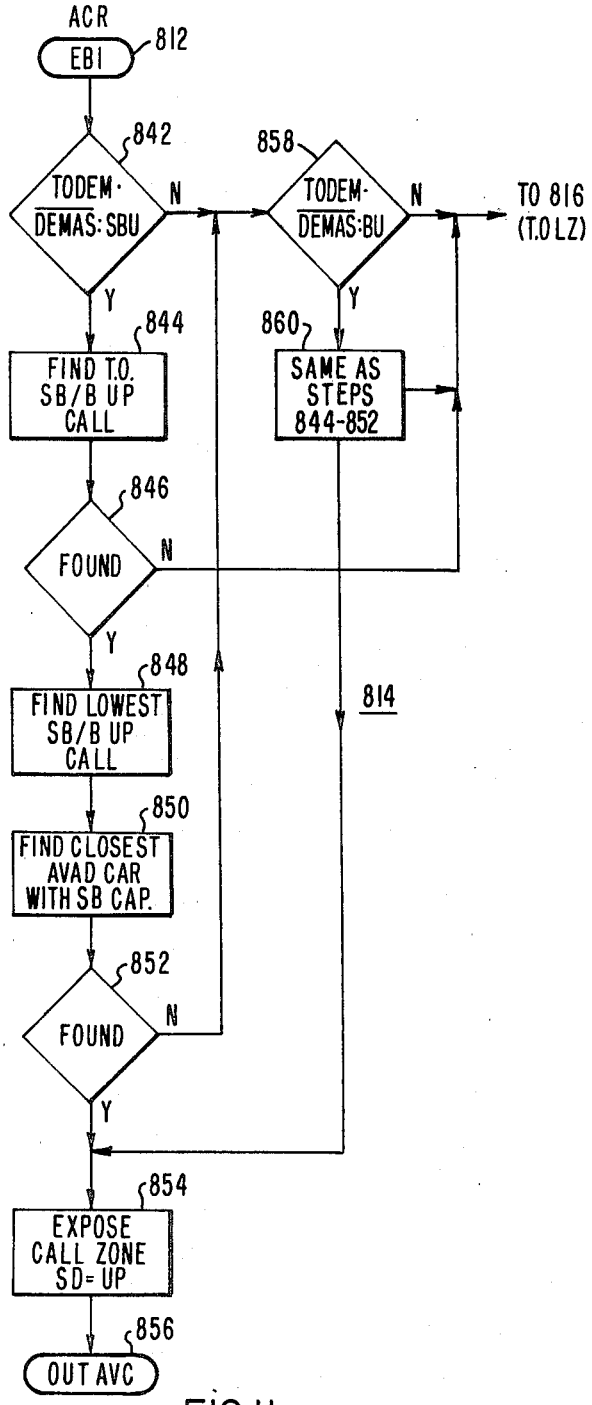
FIGS. 11, 12, 13 and 14 are flow charts for performing certain of the functions shown in block form in FIG. 10.
Figure 15:
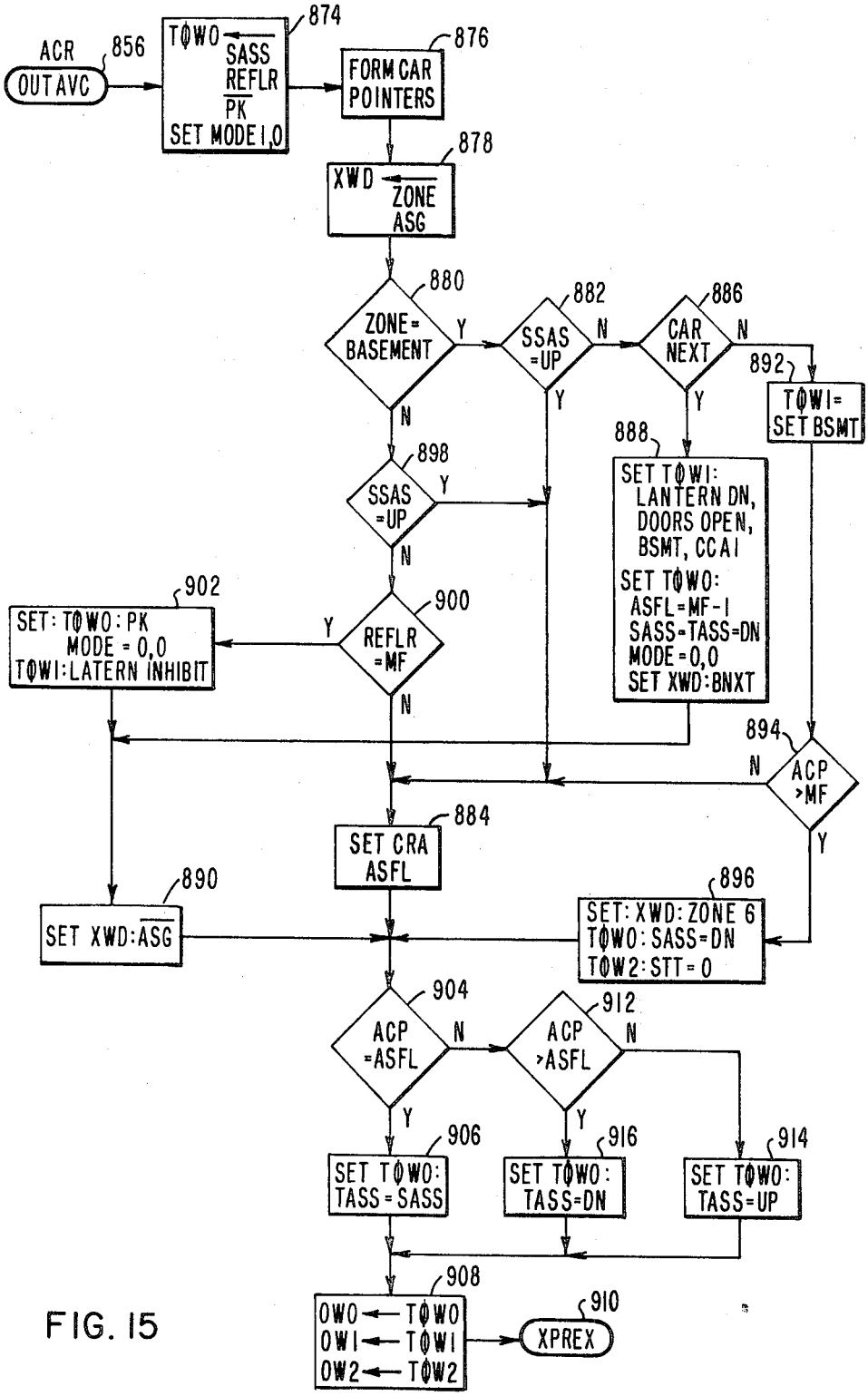
FIG. 15 is a flow chart of a subroutine which is called by the flow charts shown in FIGS. 11, 12, 13 and 14.

FIG. 11 illustrates a subprogram which may be used to satisfy a timed out basement up demand. Step 842 checks to see if there is a timed out up demand from the subbasement (bit 9 of TODEM will be a 1) which has not had a car assigned to it (bit 9 of DEMAS will be a 0). If there is a timed out up demand from the subbasement which has not been satisfied, step 844 attempts to find a timed out up call from the subbasement. Step 846 checks to see if step 844 found such a call. If so, step 848 looks for the lowest up call in the subbasement, and step 850 looks for the closest available (AVAD) car with subbasement capability. Step 852 checks to see if such a car was found by step 850, and if so, step 854 sets up the call requirements by exposing the call zone and service direction of the call. The program then proceeds to terminal 856 to output the assignment in a subroutine OUTAVC, which is shown in FIG. 15.

If step 842 finds no timed out demand in the subbasement, it advances to step 858 to check for a timed out up demand in the basement, by checking bit 3 of TODEM, which has not been satisfied (DEMAS). Finding such a demand, the program advances to step 860, which repeats steps 844 through 852, with SB/B being replaced by B.

If step 842 found no timed out subbasement up demand, the program advances to step 858 as just explained. Step 852 also advances to step 858 if it cannot find an available car with subbasement capability.

Figure 12:
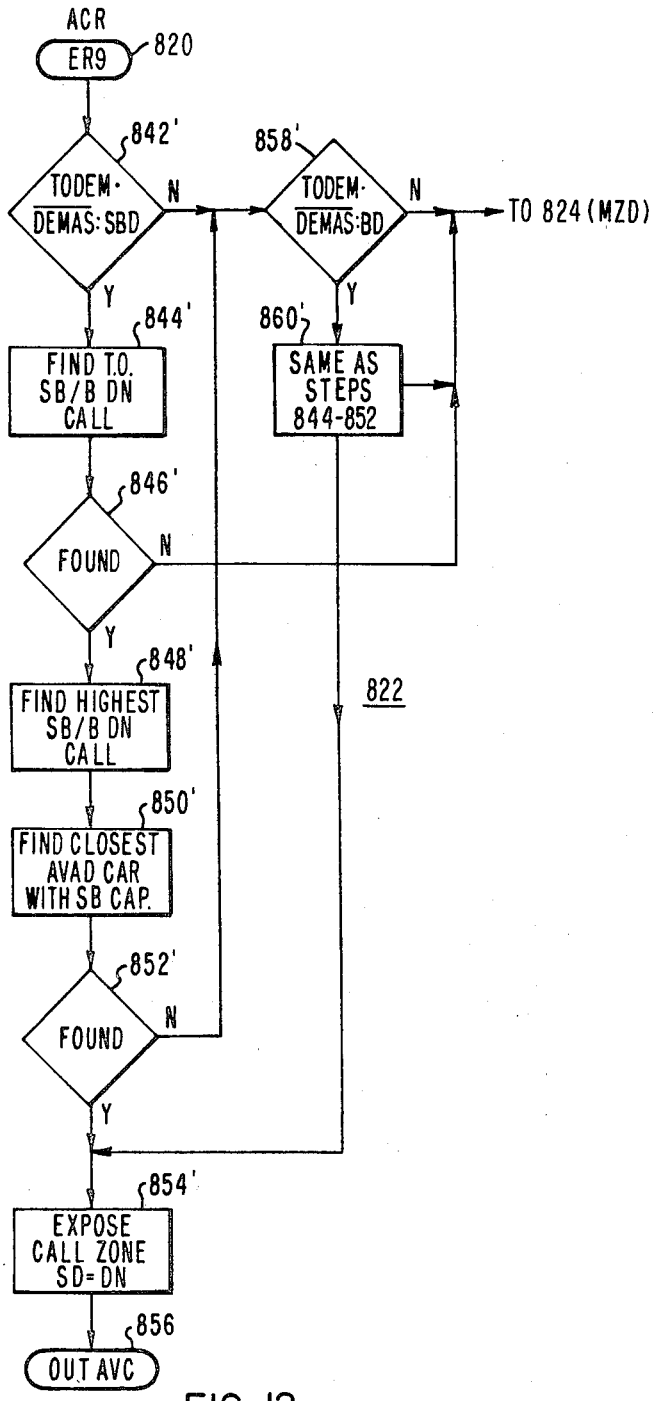

The program for finding an available car for a timed out basement down demand (bits 8 and 1 of TODEM) is shown in FIG. 12. The steps are similar to those described relative to FIG. 11, and thus a detailed description is not necessary Similar steps have been given the same reference numeral, with the addition of a prime mark.

Figure 13:
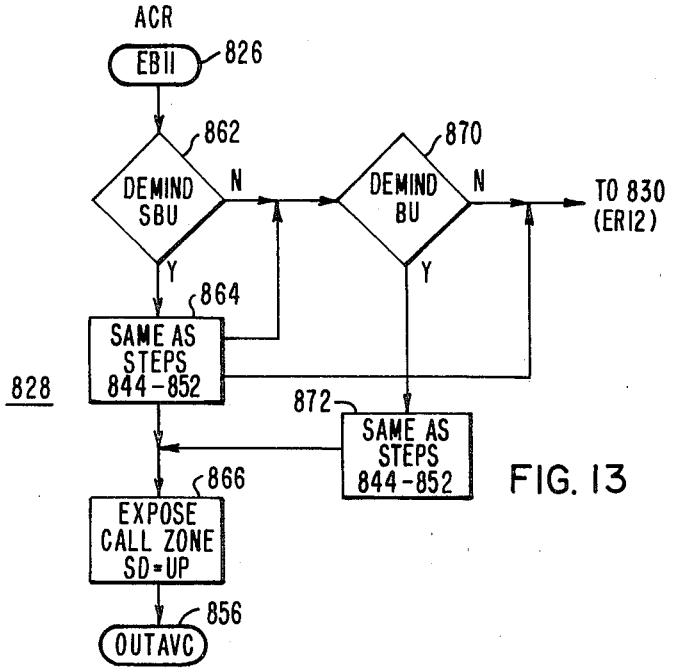

The program for finding and satisfying a subbasement up demand is shown in FIG. 13. The program is entered at terminal 826 and step 862 checks to see if there is a subbasement up demand (bit 9 of DEMIND). If so, step 864 is expanded to follow steps which are similar to steps 844–852 of FIG. 11. If these steps find a suitable AVAD car, step 866 sets up the requirements for this car by entering the subroutine OUTAVC at terminal 856.

If step 862 finds no subbasement up demand, step 870 checks for a basement up demand (bit 3 of DEMIND). Finding such a demand, step 872 expands into steps which are similar to steps 844–852 of FIG. 11, with SB/B being replaced by B.

Figure 14:
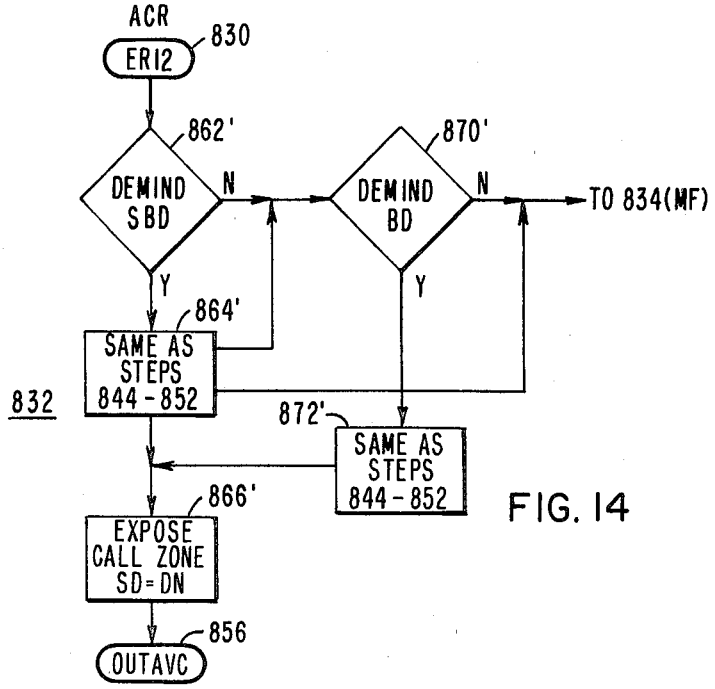

The program for finding an available car for a basement down demand (bits 8 and 1 of DEMIND) is shown in FIG. 14. The steps in FIG. 14 are similar to those in FIG. 13, with similar steps being given the same reference numerals, with the addition of a prime mark.

Subroutine OUTAVC, shown in FIG. 15, prepares the assignment words OW0, OW1 and OW2, the formats of which are shown in FIG. 4. These assignment words are sent by the programmable system processor 11 to the car controller of the car receiving the assignment. The subroutine is entered at terminal 856 and step 874 initializes temporary output word locations referred to as TOW0, TOW1 and TOW2. The assigned service direction SASS (bit 4 of TOW0) is set to indicate the service direction of the call to be served. The address FAD0-FAD6 of the call floor REFLR is stored in bits 5–11 of TOW0. PARK (bit 0) is reset, and the assignment mode bits MOD0 and MOD1 are set and reset to 1, 0, respectively, which enables the car to see calls only at the call floor. Step 876 forms the pointers for extracting information relative to the car in question from core memory. Step 878 puts the zone of the call into bits 0–2 of the extra memory word XWD for the car (FIG. 5), and the "assigned" bit 4 of XWD is set.

Step 880 checks to see if the call is from a basement zone. If it is, step 882 checks to see if the assigned service direction SASS is up. If it is up, step 884 sets the bit in the car's assignment register CRA which corresponds to the assigned floor ASFL. Therefore, steps 880, 882 and 884 direct a car assigned to a basement up call directly to the call floor, regardless of the present location of the car.

If the call is a down call from a basement floor, step 882 proceeds to step 886 which checks to see if the car has been selected as a NEXT car to leave the main floor. If it is the NEXT car, step 888 sets the lantern mode bits 8 and 9 of TOW1 to select the down lantern, i.e., HLM0 and HLM1 are set to 0, 1, respectively. Bit position 4 is set to request that the car doors open, bit 0 is set to indicate the car has a basement assignment, and bit 3 is set to inhibit car calls. The address of the floor just below the main floor is stored in bits 5–11 of TOW0, bits 3 and 4 of TOW0 are reset to select the down travel and down service directions, respectively, address mode bits 1 and 2 of TOW0 are reset 0, 0, to inhibit all floor calls to the car's floor selector, and the extra memory XWD has bit 6 set to indicate the car is the NEXT car to serve the basement from the main floor. The program then advances to step 890 which resets bit 4 of XWD to indicate the car is not an assigned car.

If step 886 finds the car is not NEXT, step 892 sets bit 0 of TOW1 to give the car a basement assignment. Step 894 checks the advanced car position. If the car is at or below the main floor, the program advances to step 884 to place the down basement call in the car's assignment register CRA, and thus send the car directly to the call floor. If the car is above the main floor, the program proceeds from step 894 to step 896 which gives the car a zone 6 assignment (bits 0–2 of XWD) and sets the service direction to down (bit 4 of TOW0), to cause the car to travel in a downward direction towards the basement.

If step 880 found the call was not from the basement zone, step 898 checks the assigned service direction. If it is up, the program advances to step 884. If it is down, step 898 proceeds to step 900 which checks to see if the assigned floor (REFLR) is the main floor. If it is not the main floor, the program proceeds to step 884. If it is the main floor, the program goes to step 902 which sets bit 0 of TOW0 to give the car a PARK assignment, it inhibits floor calls by resetting bits 1 and 0 of TOW0 to 0, 0, and bits 8 and 9 of TOW1 are reset 0, 0 to inhibit both directions of the hall lantern. The program then proceeds to step 890.

Steps 890, 884 and 896 all proceed to step 904 to start the portion of the program which appropriately sets the travel direction of the car relative to the assignment floor. Step 904 first checks to see if the car is already at the assigned floor ASFL. If it is, step 906 sets the travel direction TASS, bit 3 of TOW1, to the assigned service direction SASS, which has been previously set to the call service direction, the program advances to step 908 which transfers the contents of the temporary words to the memory locations of the car output words, and the program returns to the priority executive from terminal 910.

If step 904 finds the car is not located at the assigned floor ASFL, step 912 checks to see if the car is above the assigned floor. If it is not, step 914 sets the assigned travel direction TASS to UP. If it is, step 916 sets the assigned travel direction TASS to down. Both steps 914 and 916 proceed to step 908, which transfers the temporary words to the permanent word location, and then to the car controller.

In summary, there has been disclosed a new and improved elevator system which improves elevator service to the floors located below the main floor by dividing these floors into two zones according to service direction, i.e., a basement up zone, and a basement down zone. Demands created by calls in these zones are assigned to available cars by a new and improved priority ranking which gives basement up calls a higher priority than basement down calls. Further, basement up calls are given a higher priority than demands due to up calls registered from floors located above the main floor, as the uptraveling basement car will be naturally in position to serve up calls registered from floors above the main floor.

We claim as our invention:

1. An elevator system for a structure having a plurality of floors, including a main floor, a plurality of floors above the main floor, and a plurality of basement floors located below the main floor, comprising:

a plurality of elevator cars, means mounting said elevator cars for movement relative to the structure for serving the floors, up and down hall call registration means for registering calls for elevator service in the up and down service directions from at least certain of the floors, zone means for dividing the floors, and service directions therefrom, into a plurality of zones, including up and down service direction zones for the plurality of basement floors, and selecting means for selecting elevator cars to answer calls for elevator service from said zones according to a predetermined zone priority order, with the up service direction basement zone having a higher priority than the down service direction basement zone.

2. The elevator system of claim 1 wherein the zone means includes at least one up service direction zone above the main floor, and including availability means which determines when an elevator car is available for assignment, with the cars which are available for assignment being assigned to calls in the zones according to the predetermined zone priority order, and wherein the up service direction basement zone has a higher priority than up service direction zones located above the main floor.

3. The elevator system of claim 1 wherein the zone means includes at least one up service direction zone above the main floor, and wherein the control means includes allocation means which allocates a call for service to a suitably conditioned busy car which is in the process of serving another call, when such a car is found, and which creates a demand for the zone of the call when such a car is not found, and including availability means and assignment means, said availabilty means determining when an elevator car is available for assignment, with the cars which are available for assignment being assigned by said assignment means to the demands from the zones according to the predetermined zone priority order, and wherein the up service direction basement zone has a higher priority than up service direction zones located above the main floor.

4. The elevator system of claim 3 including means for timing each call and for indicating that a call has timed out when it has been registered for a predetermined period of time, with demands associated with timed-out calls in the basement up zone being higher in the predetermined zone priority order than timed-out calls for up service from floors located above the main floor.

5. The elevator system of claim 3 including means for timing each call and for indicating that a call has timed out when it has been registered for a predetermined period of time, with said predetermined period of time being a different value for basement up and basement down calls.

6. The elevator system of claim 3 wherein the allocation means creates a demand for the basement up zone in response to an up call from the basement zone which it cannot allocate to a car in the basement zone in position to answer the call which has an up-travel service direction.

7. The elevator system of claim 6 wherein the assignment means assigns an available car to the lowest up call in the basement up zone in response to a demand therefrom, and the allocation means determines whether a car has already been assigned to the lowest up call from the basement up zone before creating a demand for the basement up zone.

8. An elevator system for a structure having a plurality of floors, including a main floor, a plurality of floors above the main floor, and a plurality of basement floors located below the main floor, comprising:

a plurality of elevator cars, means mounting said elevator cars for movement relative to the structure to serve the floors, up and down floor call registration means for registering calls for elevator service in the up and down service directions from at least certain of the floors, zone means for dividing the floors, and service directions therefrom, into a plurality of zones, including up and down service direction zones for the plurality of basement floors, allocation means for allocating a floor call to a suitably conditioned busy car, if one is found, and otherwise creating a demand for the zone of the floor call, availability means for determining when each of said elevator cars is available for assignment to serve demands created by said allocation means, and selecting means for selecting an available one of the elevator cars to serve demands created by said allocation means according to a predetermined zone priority order, with the up service direction basement zone having a higher priority than the down service direction basement zone.

9. The elevator system of claim 8 wherein the zone means includes at least one up service direction zone above the main floor, the selecting means includes assigning means for assigning a selected available car to the lowest up call from the basement up zone when assigning a car to satisfy a demand from the basement up zone, and wherein the up service direction basement zone has a higher priority than up service direction zones located above the main floor.

* * * * *